US006677274B2

(12) United States Patent
Geuens et al.

(10) Patent No.: US 6,677,274 B2
(45) Date of Patent: Jan. 13, 2004

(54) THERMOGRAPHIC RECORDING MATERIAL WITH IMPROVED IMAGE TONE

(75) Inventors: Ingrid Geuens, Emblem (BE); Ivan Hoogmartens, Wilrijk (BE); Geert Defieuw, Bonheiden (BE)

(73) Assignee: Agfa-Gevaert (BE)

( * ) Notice: Subject to any disclaimer, the term of this patent is extended or adjusted under 35 U.S.C. 154(b) by 162 days.

(21) Appl. No.: 09/864,837

(22) Filed: May 24, 2001

(65) Prior Publication Data

US 2002/0052294 A1 May 2, 2002

Related U.S. Application Data

(60) Provisional application No. 60/243,585, filed on Oct. 27, 2000.

(30) Foreign Application Priority Data

May 25, 2000 (EP) ..... 00201851
Sep. 13, 2000 (EP) ..... 00203167

(51) Int. Cl.[7] ..... B41M 5/30
(52) U.S. Cl. ..... 503/212; 503/209
(58) Field of Search ..... 503/209, 212

(56) References Cited

U.S. PATENT DOCUMENTS 3,080,254 A 3/1963 Grant

FOREIGN PATENT DOCUMENTS

EP 0 599 369 B1 6/1994
EP 0 752 616 B1 1/1997
EP 0 848 286 A1 6/1998
EP 1 004 929 A1 5/2000
EP 1 006 405 A1 6/2000
EP 1 059 560 A1 12/2000

*Primary Examiner*—Bruce H. Hess
(74) *Attorney, Agent, or Firm*—Leydig, Voit & Mayer, Ltd.

(57) ABSTRACT

A substantially light-insensitive thermographic recording material comprising a support and a thermosensitive element, the thermosensitive element containing silver behenate including phase I silver behenate having an X-ray diffraction spectrum upon irradiation with a copper $K\alpha_1$ X-ray source with Bragg angles 2Θ of 4.53°, 5.96–6.05°, 7.46–7.56°, 8.90–9.12°, 10.45–10.66°, 12.02–12.12°, 13.53–13.62°, a reducing agent therefor in thermal working relationship therewith and a binder, wherein the thermographic recording material is capable upon thermal development of containing 1% of phase II silver behenate, having an X-ray diffraction spectrum upon irradiation with a copper $K\alpha_1$ X-ray source with Bragg angles 2Θ of 5.34–5.78°, 6.12–6.41°, 7.68–7.79°, 8.30–8.59°, 9.36–9.84°, 10.6–10.96°, and/or phase III silver behenate phase, having an X-ray diffraction spectrum upon irradiation with a copper $K\alpha_1$ X-ray source with Bragg angles 2Θ of 4.76–4.81°, 5.9–6.3°, 6.76–7.35°, 8.27–8.44° and 9.06–9.43°, which is stable at 25° C., with respect to the quantity of the phase I silver behenate in the thermographic recording material before said thermal development; a recording process therefor; and use of the above-defined phase II silver behenate stabilized at 25° C. and/or the above-defined phase III silver behenate stabilized at 25° C. as a tone modifier in thermographic recording materials.

37 Claims, 2 Drawing Sheets

THERMOGRAPHIC RECORDING MATERIAL WITH IMPROVED IMAGE TONE

This application claims the benefit of U.S. provisional patent application No. 60/243,585, filed Oct. 27, 2000.

FIELD OF THE INVENTION

The present invention relates to tone modifiers for use in thermographic recording materials.

BACKGROUND OF THE INVENTION

M. Ikeda in 1980 in Photographic Science and Engineering, Volume 24, Number 6, pages 277–280, disclosed a thermodynamic and NMR study on several silver salts of fatty acids (silver behenate, silver stearate, silver palmitate, silver myristate and silver laurate). The results of thermal analyses indicated that the salts exhibit thermotropic liquid crystalline behaviour analogous to those of the alkali metal soaps and that formation in silver behenate of the mesophase, called "sub-waxy", was available for development in the case of a commercial dry silver paper. M. Ikeda and Y. Iwata also in 1980 in Photographic Science and Engineering, Volume 24, Number 6, pages 273–276, disclosed a study of the morphology and structure of silver laurate and silver behenate. It was found that these salts undergo phase transitions with increasing temperature. A polarizing microscope was used to determine how the molecular alignment in silver laurate changed with increasing temperature, a super-curd phase (implying crystal phases having different crystal structure) being observed at 109° C. and a sub-waxy phase (a mesophase inherent in liquid crystals) at 114° C. In the mesophase, formed at a temperature higher than 120° C., which generally corresponded to the heat-developable temperature for dry silver paper, the arrangement of Ag atoms was unalterable, but the orientation of the paraffinic chains was random. For silver behenate the long spacing, the distance between Ag atom layers, was found to be unalterable through sub-waxy.

Thermal imaging or thermography is a recording process wherein images are generated by the use of thermal energy. In direct thermal thermography a visible image pattern is formed by image-wise heating of a recording material containing matter.

U.S. Pat. No. 3,080,254 specifically discloses a substantially light-insensitive thermographic recording material with a thermosensitive element containing silver behenate, phthalazinone and polyvinyl butyral.

U.S. Pat. No. 3,951,660 discloses a photographic radiation sensitive recording material having therein a radiation sensitive composition and at least one layer containing dispersed in a binding agent a substantially non-light sensitive silver salt, a reducing agent for the non-light-sensitive salt, and a toner compound, the improvement which comprises the toner being a heterocyclic toner compound of the following formula:

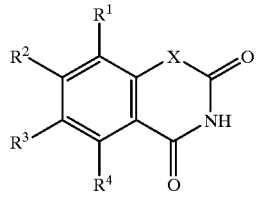

in which X represents O or N—$R^5$; $R^1$, $R^2$, $R^3$ or $R^4$ represent hydrogen, alkyl, cycloalkyl, alkoxy, alkylthio, hydroxy, dialkylamino or halogen, in addition to which $R^1$ and $R^2$ or $R^2$ and $R^3$ or $R^3$ and $R^4$ can represent the ring members required to complete an anullated aromatic ring, and $R^5$ represents alkyl.

EP 599 369, EP 669 875, EP 669 876 and EP 726 852 disclose in their invention examples substantially light-insensitive thermographic recording materials with a thermosensitive element consisting of silver behenate, 3,3,3',3'-tetramethyl-5,6,5',6'-tetrahydroxy-1'1'-spiro-bis-indane, polyvinyl butyral, benzo[e][1,3]oxazine-2,4-dione (compound 25 in U.S. Pat. No. 3,951,660) and silicone oil in which the weight ratio of silver behenate to polyvinyl butyral varies between 2:1 and 1:1 and the molar ratio of benzo[e][1,3]oxazine-2,4-dione to silver behenate is about 0.20.

EP-A 752 616 discloses a thermographic material comprising at least one element and wherein the element(s) contain(s) therein a substantially light-insensitive organic heavy metal salt and an organic reducing agent therefor, the material being capable of thermally producing an image from the organic heavy metal salt and reducing agent, wherein the material contains a 1,3-benzoxazine-2,4-dione toning agent having general formula (I):

(I)

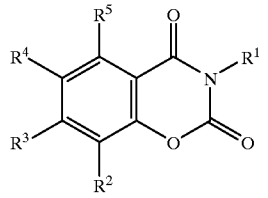

wherein $R^1$ represents hydrogen, —$CH_2OH$, —(C═O)—R, —CONHR, or M; $R^2$, $R^3$, $R^4$ and $R^5$ each independently represents hydrogen, —O—(C═O)—OR or —NH—(C═O)—OR and at least one of which is not hydrogen if $R^1$ is also hydrogen; R represents an alkyl or aryl group either of which may be substituted; and M represents a monovalent heavy metal ion.

EP-A 752 616 specifically discloses substantially light-insensitive thermographic recording materials with a thermosensitive element containing silver behenate and 5, 10 and 20 mol % 7-(ethylcarbonato)-benzo[e][1,3]oxazine-2,4-dione (compound 1) with respect to silver behenate.

In printing with thermographic materials for medical applications and graphic arts applications it is desirable to increase the throughput of thermographic materials. This requires that thermal development take place over as short a period as possible. In the case of substantially light-insensitive thermographic recording materials in which thermal development is obtained by image-wise heating, this requires that the heating time per pixel be as short as possible. In the case of image-wise heating with the resistance elements of a thermal head, this means that the line time of the thermal head be as short as possible without loss in image tone in continuous tone images. Image tone can be assessed on the basis of the L*, a* and b* CIELAB-values, which are determined by spectrophotometric measurements according to ASTM Norm E179-90 in a R(45/0) geometry with evaluation according to ASTM Norm E308-90.

OBJECTS OF THE INVENTION

It is an object of the present invention to provide a novel tone modifier for use in substantially light-insensitive thermographic recording materials.

It is a further object of the present invention to provide a means of obtaining clinically acceptable image tones in high throughput substantially light-insensitive thermographic recording material for printers with thermal head line times of 20 ms to 4.5 ms or less at a resolution of at least 118 dots per cm (=300 dots per inch).

Further objects and advantages of the invention will become apparent from the description hereinafter.

SUMMARY OF THE INVENTION

Three crystalline phases of silver behenate have been identified by X-ray diffraction measurements with a copper $K\alpha_1$ X-ray source, which have been designated: phase I, phase II and phase III. At 25° C. pure silver behenate only exists in the well-known crystalline phase designated as phase I [ICDD reference spectrum: 4.53°, 6.01°, 7.56°, 9.12°, 10.66°, 12.12° and 13.62° (National Institute of Standards, Gaithersburg, Md.-20899-0001, USA)] and as an amorphous phase. Phase II silver behenate, a mesomorphous phase having an X-ray diffraction spectrum upon irradiation with a copper $K\alpha_1$ X-ray source with Bragg angles 2Θ of 5.34–5.78°, 6.12–6.41°, 7.68–7.79°, 8.30–8.59°, 9.36–9.84°, 10.6–10.96°, and phase III silver behenate, a mesomorphous phase having an X-ray diffraction spectrum upon irradiation with a copper $K\alpha_1$ X-ray source with Bragg angles 2Θ of 4.76–4.81°, 5.9–6.3°, 6.76–7.35°, 8.27–8.44° and 9.06–9.43° are, in the case of pure silver behenate, only stable between 130–140° C. and ca. 156° C.; and between ca. 156° C. and ca. 180° C. respectively.

It has been surprisingly found that phase II and phase III are identifiable on the basis of their X-ray diffraction spectra in certain substantially light-insensitive thermographic recording materials after thermographic printing. Furthermore, the presence of these silver behenate phases in the printed thermographic materials could surprisingly be correlated with improved image tone. Therefore, such silver behenate phases, when stabilized at room temperature, act as tone modifiers.

Surprisingly, it has been found in model experiments that phase II and phase III silver behenate, which for pure silver behenate are only stable at temperatures between 130–140 and ca. 156° C. and ca. 156° C. and ca. 180° C. respectively, can be stabilized at 25° C. to different degrees by the presence of a compound selected from the group consisting of: glutaric acid, benzo[e][1,3]-oxazine-2,4-dione; substituted benzo[e][1,3]-oxazine-2,4-dione compounds such as 7-(ethylcarbonato)-benzo[e][1,3]-oxazine-2,4-dione, 7-methyl-benzo[e][1,3]-oxazine-2,4-dione and 7-methoxy-benzo[e][1,3]-oxazine-2,4-dione; phthalazinone; and polyvinyl butyral, or combinations thereof. The broadness of the XRD-peaks for these two phases leads to significant XRD-peak overlap between the two phases, when present at the same temperature. This stabilization of phase II and phase III silver behenate is only observable in materials in which all the residual silver behenate is not converted into another silver salt, during the thermal development process.

A possible explanation for the tone modifying effect of phase II and phase III silver behenate is that these phases promote the formation of metallic silver nuclei clusters with a size at which light scattering produces a blue-black neutral image tone [≧160 nm according to Bird in Photographic Science and Engineering, volume 15, page 356 (1971)].

The above-mentioned objects are realized by providing a substantially light-insensitive thermographic recording material comprising a support and a thermosensitive element, the thermosensitive element containing silver behenate including phase I silver behenate having an X-ray diffraction spectrum upon irradiation with a copper $K\alpha_1$ X-ray source with Bragg angles 2Θ of 4.53°, 5.96–6.05°, 7.46–7.56°, 8.90–9.12°, 10.45–10.66°, 12.02–12.12°, 13.53–13.62°, a reducing agent therefor in thermal working relationship therewith and a binder, wherein the thermographic recording material is capable upon thermal development of containing 1% of phase II silver behenate, having an X-ray diffraction spectrum upon irradiation with a copper $K\alpha_1$ X-ray source with Bragg angles 2Θ of 5.34–5.78°, 6.12–6.41°, 7.68–7.79°, 8.30–8.59°, 9.36–9.84°, 10.6–10.96°, which is stable at 25° C., and/or phase III silver behenate phase, having an X-ray diffraction spectrum upon irradiation with a copper $K\alpha^1$ X-ray source with Bragg angles 2Θ of 4.76–4.81°, 5.9–6.3°, 6.76–7.35°, 8.27–8.44° and 9.06–9.43°, which is stable at 25° C., with respect to the quantity of the phase I silver behenate in the thermographic recording material before the thermal development.

A recording process is also provided by the present invention for a thermographic recording material, the thermographic recording material comprising a thermosensitive element, the thermosensitive element comprising silver behenate including the above-defined phase I silver behenate, an organic reducing agent therefor in thermal working relationship therewith and a binder, comprising: (i) converting the silver behenate into the above-defined phase II silver behenate and/or the above-defined phase III silver behenate; and (ii) cooling the thermographic recording material to 25° C., wherein at least 1% of the phase II silver behenate and/or the phase III silver behenate, with respect to the quantity of the phase I silver behenate in the thermographic recording material before the recording process, is present in the cooled thermally developed thermographic recording material at 25° C. as stable phases.

A use is also provided by the present invention of the above-defined phase II silver behenate stabilized at 25° C. and/or the above-defined phase III silver behenate defined in claim 1 stabilized at 25° C. as a tone modifier in thermographic recording materials.

Preferred embodiments of the present invention are disclosed in the dependent claims.

DETAILED DESCRIPTION OF THE INVENTION

The invention is described hereinafter by way of reference to the accompanying figure wherein.

In a preferred thermographic recording material according to the present invention said thermographic recording material upon thermal development contains at least 2% of the phase II silver behenate, which is stable at 25° C., and/or the phase III silver behenate, which is stable at 25° C., with respect to the quantity of the phase I silver behenate in the thermographic recording material before the thermal development. In a particularly preferred thermographic recording material according to the present invention upon thermal development said thermographic recording material contains at least 5% of the phase II silver behenate, which is stable at 25° C., and/or the phase III silver behenate with respect to the phase I silver behenate, which is stable at 25° C., with respect to the quantity of the phase I silver behenate in the thermographic recording material before the thermal development.

In a further preferred thermographic recording material of the present invention, the reducing agent is 3,4-dihydroxybenzonitrile.

In a still further preferred thermographic recording material of the present invention, phase II silver behenate and/or phase III silver behenate is stabilized by the presence of a compound selected from the group consisting of: glutaric acid, benzo[e][1,3]-oxazine-2,4-dione, substituted benzo[e][1,3]-oxazine-2,4-dione compounds, phthalazinone and polyvinyl butyral.

In another preferred thermographic recording material, according to the present invention, the thermographic recording material is a black and white thermographic recording material.

Definitions

By substantially light-insensitive is meant not intentionally light sensitive.

The term thermographic recording material as used in the present specification includes both substantially light-insensitive thermographic recording materials and photothermographic recording materials.

Mesomorphous means in a mesomorphic state, which is a state of matter intermediate between a crystalline solid and a normal isotropic liquid, in which long rod-shaped organic molecules contain dipolar and polarizable groups.

Liquid crystalline means a liquid state in which the liquid is not isotropic and as a result of the orientation of molecules parallel to one another in large clusters is birefringent and exhibits interference in polarized light.

A black and white thermographic recording material is a thermographic recording material producing a monotone blue-black image.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Silver Behenate

Figure 1:
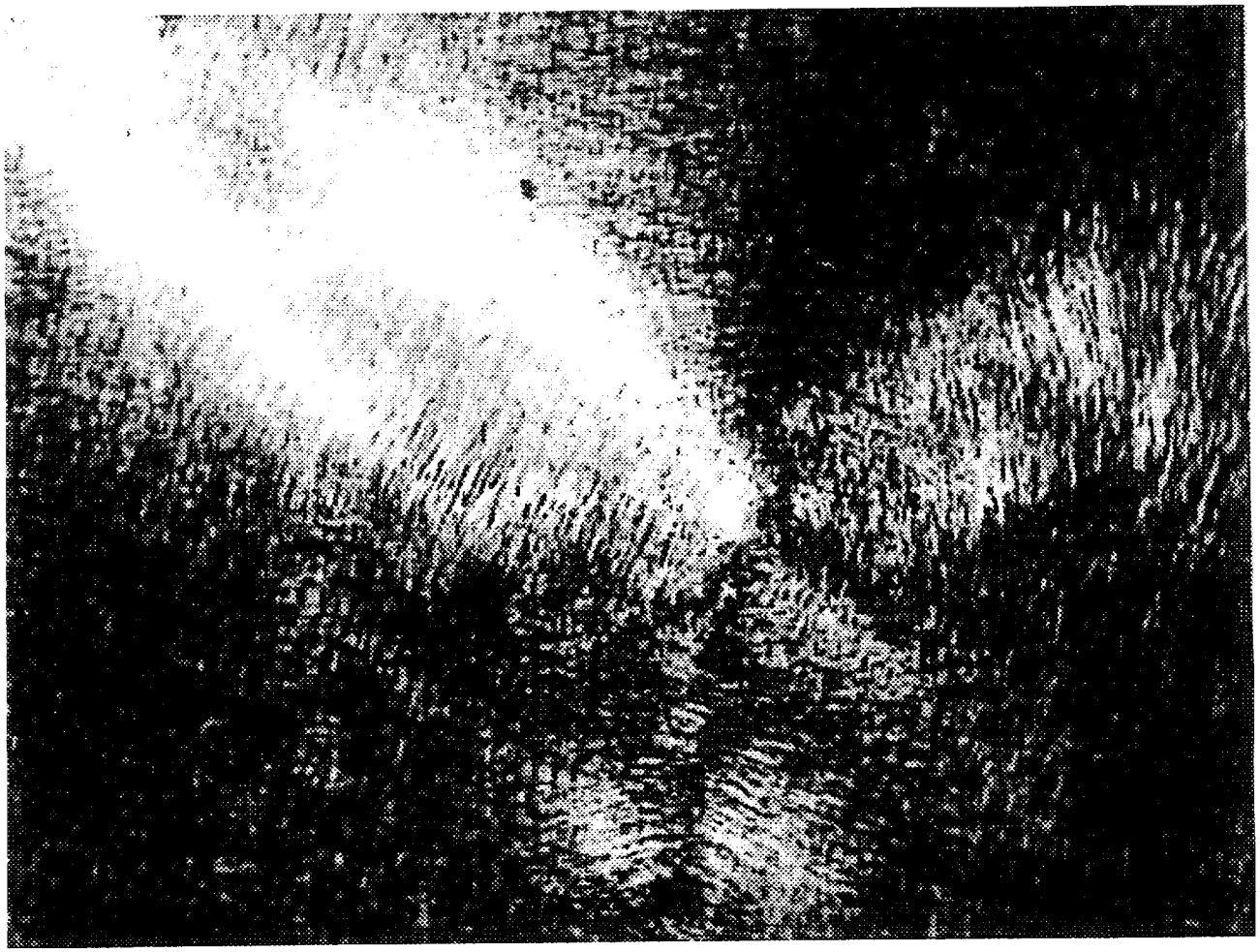
FIG. 1 is an image of silver behenate at 150° C. taken with a video camera mounted on a polarization microscope with cross polarizers and a hot stage and a phase II liquid crystalline phase (smectic A) of silver behenate with clearly visible orientation.
Figure 2:
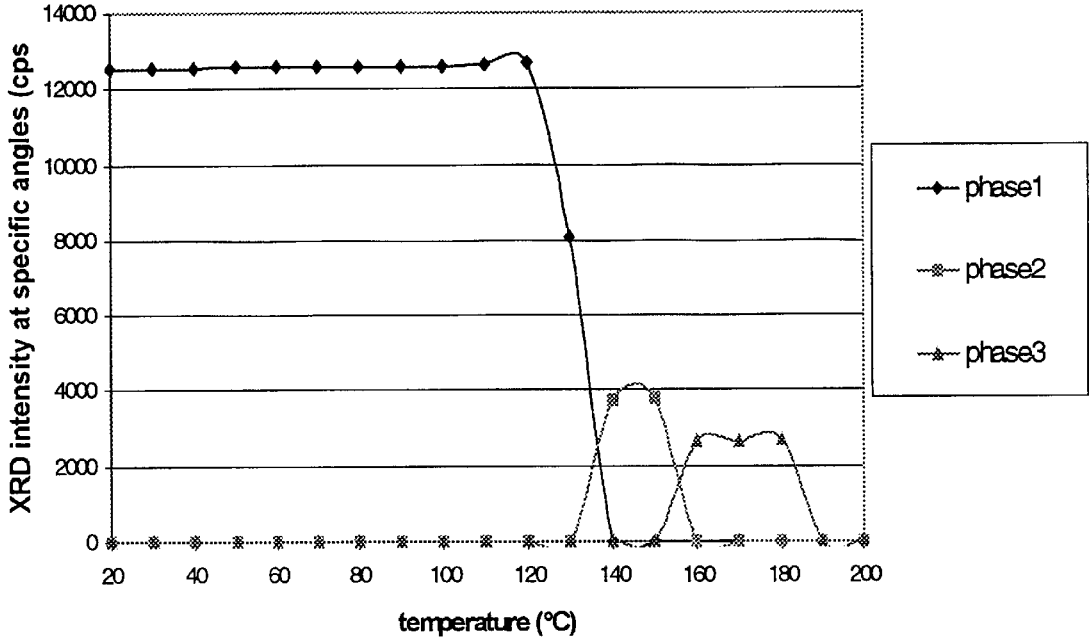
FIG. 2 represents the relative concentrations of phase I, phase II and phase III silver behenate as a function of temperature upon heating up pure silver behenate.

Three crystalline phases of silver behenate have been identified by x-ray diffraction measurements with a copper $K\alpha^1$ X-ray source. At 25° C. silver behenate exists in the well-known crystalline phase designated as phase I [ICDD reference spectrum: 4.53°, 6.01°, 7.56°, 9.12°, 10.66°, 12.12° and 13.62° (National Institute of Standards, Gaithersburg, Md.-20899-0001, USA)] and as an amorphous phase. Upon heating solid silver behenate, phase I silver behenate exists up to a temperature of 120 to 130° C. in which temperature range amorphous silver behenate begins to be formed. This birefringent (doubly refractive) silver behenate phase, which will be designated as phase II, is observed at temperatures between 130–145° C., depending upon the sample, and ca. 156° C. It exhibits a clear anisotropy i.e. it is a liquid crystalline (mesomorphous) smectic A phase (as confirmed by polarization microscopy, see FIG. 1). From a temperature of 156° C. further changes are observed in the lattice spacings of the silver behenate, indicating a second phase transition to the mesomorphous phase III silver behenate. Phase III silver behenate is observed at temperatures between ca. 156° C. and ca. 180° C. FIG. 2 summarizes these phase transitions. The precise process by which the phase I silver behenate or the amorphous silver behenate in the substantially light-insensitive thermographic recording material is converted during printing into phase II silver behenate and phase III silver behenate is not important to the present invention, since only the fact that such a conversion has taken place and that these phases are stabilized at 25° C. is important to the present invention.

No difference was be observed between phase II silver behenate and phase III silver behenate under a polarization microscope, both phases being mesomorphous. However, clear differences are observed in XRD and DSC behaviour, the XRD spectrum of phase III silver behenate being shifted to lower Bragg 2Θ angles with respect to phase II silver behenate, indicating reduced d-values i.e. reduced separation between polarizable groups in the mesomorphous phase of the silver behenate. The X-ray diffaction peaks observed with phase II and phase III silver behenate are significantly broader than those observed for phase I silver behenate.

Table 1 gives the Bragg 2Θ angles of the principal XRD-peaks of phases I, II and III silver behenate. It should be noted that neither phase II nor phase III silver behenate is stable at 25° C. in the absence of stabilizing compounds.

TABLE 1

| Silver behenate phase | Temperature range in which pure silver behenate is stable [° C.] | Bragg angles 2Θ of silver behenate phase upon irradiation with a copper $K\alpha_1$ X-ray source |
|---|---|---|
| Phase I | below ca. 135° C. | 4.53°, 5.96–6.05°, 7.46–7.56°, 8.90–9.12°, 10.45–10.66°, 12.02–12.12°, 13.53–13.62° |
| Phase II | 130–140 to ca. 156° C. | 5.34–5.78°, 6.12–6.41°, 7.68–7.79°, 8.30–8.59°, 9.36–9.84°, 10.6–10.96° |
| Phase III | ca. 156 to ca. 180° C. | 4.76–4.81°, 5.9–6.3°#, 6.76–7.35°, 8.27–8.44°, 9.06–9.43° |

#overlap with phase I silver behenate

Thermosensitive Element

The thermosensitive element, according to the present invention, contains silver behenate including phase I silver behenate, at least one organic reducing agent therefor in thermal working relationship therewith and a binder. The element may comprise a layer system in which the ingredients may be dispersed in different layers, with the proviso that silver behenate is in reactive association with the organic reducing agent i.e. during the thermal development process the organic reducing agent must be present in such a way that it is able to diffuse to the particles of silver behenate or other substantially light-insensitive organic silver salt so that reduction to silver can occur. Addition of photosensitive silver halide to the thermosensitive element in catalytic association with the silver behenate renders the thermosensitive element photo-addressable.

Organic Reducing Agents

Suitable organic reducing agents for the reduction of silver behenate are organic compounds containing at least one active hydrogen atom linked to O, N or C, such as is the case with, aromatic di- and tri-hydroxy compounds. 1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred. In particularly preferred substantially light-insensitive thermographic materials according to the present invention the at least one organic reducing agent is described in EP-B 692 733 e.g. ethyl 3,4-dihydroxybenzoate, n-butyl 3,4-dihydroxybenzoate and/or EP-A 903 625 e.g. 3,4-dihydroxybenzonitrile, 3,4-dihydroxyacetophenone and 3,4-dihydroxybenzophenone. In an especially preferred embodiment of the present invention the at least one organic reducing agent comprises 3,4-dihydroxybenzonitrile in a concentration of at least 30 mol % with respect to the substantially light-insensitive organic silver salt.

Combinations of organic reducing agents may also be used that on heating become reactive partners in the reduction of the substantially light-insensitive organic silver salt containing mixed crystals of two or more organic silver salts. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130. Combinations of ethyl 3,4-dihydroxybenzoate with 3,4-dihydroxybenzonitrile and 3,4-dihydroxybenzophenone with 3,4-dihydroxybenzonitrile are particularly preferred.

Aliphatic Polycarboxylic Acids and Anhydrides Thereof

According to a preferred embodiment of the thermographic recording material according to the present invention, the thermosensitive element further contains at least one polycarboxylic acid and/or anhydride thereof in a molar percentage of at least 20 with respect to the substantially light-insensitive organic silver salt comprising phase I silver behenate and in thermal working relationship therewith. The aliphatic polycarboxylic acid may be saturated, unsaturated or cycloaliphatic as disclosed in U.S. Pat. No. 5,527,758, e.g. an α,ω-alkyldicarboxylic acid, and may be used in anhydride form, in particular an intramolecular form, or partially esterified on the condition that at least two free carboxylic acid groups remain or are available in the thermal development step. Glutaric acid, an α,ω-alkyldicarboxylic acid, is a particularly strong stabilizer of phase II and phase III silver behenate at room temperature (25° C.).

Binder of the Thermosensitive Element

The film-forming binder of the thermosensitive element may be all kinds of natural, modified natural or synthetic resins or mixtures of such resins, in which the mixed crystals of two or more organic silver salts can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. Polyvinyl butyral is a stabilizer of phase II and phase III silver behenate at room temperature (25° C.).

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatine, modified gelatines such as phthaloyl gelatine, polysaccharides, such as starch, gum arabic and dextran and water-soluble cellulose derivatives. A preferred water-soluble binder for use in the thermographic recording materials of the present invention is gelatine.

Binders are preferred which do not contain additives, such as certain antioxidants (e.g. 2,6-di-tert-butyl-4-methylphenol), or impurities which adversely affect the thermographic properties of the thermographic recording materials in which they are used.

Additional Toning Agents

In a preferred embodiment of the substantially light insensitive thermographic recording material of the present invention, the thermosensitive element may further contain one or more additional toning agents known from thermography in order to obtain a neutral black image tone in the higher densities and neutral grey in the lower densities.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB 1,439,478, U.S. Pat. No. 3,951,660 and U.S. Pat. No. 5,599,647 and in particular benzo[e][1,3]oxazine-2,4-dione, 7-methyl-benzo[e][1,3]oxazine-2,4-dione, 7-methoxy-benzo[e][1,3]oxazine-2,4-dione, 7-(ethylcarbonato)-benzo[e][1,3]oxazine-2,4-dione and phthalazinone.

Antifoggants

Antifoggants may be incorporated into the thermographic recording materials of the present invention in order to obtain improved shelf-life and reduced fogging.

Preferred antifoggants are benzotriazole, substituted benzotriazoles, tetrazoles, mercaptotetrazoles and aromatic polycarboxylic acid such as ortho-phthalic acid, 3-nitrophthalic acid, tetrachlorophthalic acid, mellitic acid, pyromellitic acid and trimellitic acid and anhydrides thereof.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

Support

The support for the thermosensitive element according to the present invention may be opaque, transparent or translucent and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

Protective Layer

According to a preferred embodiment of the recording material, according to the present invention, the thermosensitive element is provided with a protective layer to avoid local deformation of the thermosensitive element and to improve resistance against abrasion.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

The protective layer according to the present invention may be crosslinked. Crosslinking can be achieved by using crosslinking agents such as those described in WO 95/12495.

Solid or liquid lubricants or combinations thereof are suitable for improving the slip characteristics of the thermographic recording materials according to the present invention. Preferred solid lubricants are thermomeltable particles such as those described in WO 94/11199.

The protective layer of the thermographic recording material according to the present invention may comprise a matting agent. Preferred matting agents are described in WO 94/11198, e.g. talc particles, and optionally protrude from the protective layer.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In a preferred embodiment of the recording process of the present invention, the recording process further comprises thermal development at a line time of less than 20 ms and at an image resolution of at least 118 dots per cm (=300 dots per inch), with a line time of 7 ms or less with an image resolution of at least 118 dots per cm being preferred and a line time of 4.5 ms or less with an image resolution of at least 118 dots per cm being particularly preferred.

In the recording process for a thermographic recording, according to the present invention, silver behenate including phase I silver behenate is converted into phase II and/or phase III silver behenate and cooling the thermographic recording material to 25° C., whereby at least 1% of phase II and/or phase III silver behenate with respect to the phase I silver behenate in the thermographic recording material before thermal development is present in the cooled thermographic recording material as stable phases. This conversion process preferably takes place by means of heat and requires the presence of compounds which stabilize phase II and/or phase III silver behenate at 25° C.

In a further preferred embodiment of the recording process, according to the present invention, the heat source is a thermal head with a thin film thermal head being particularly preferred.

In a still further preferred embodiment of the recording process, according to the present invention, the thermal development takes place under substantially water-free conditions.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

During thermal development of substantially light-insensitive thermographic materials according to the present invention the silver behenate is converted into an amorphous phase only part of which is converted into elemental silver particles. After thermal development the non-converted silver behenate may be present in one or more of the following states: an amorphous state, in the same crystalline state as that prior to thermal development and in one or more new crystalline states. Such new crystalline states may include one or more liquid crystalline states as the organic silver salt is heated up or cooled down.

Image-wise heating of the recording material can also be carried out using an electrically resistive ribbon incorporated into the material. Image- or pattern-wise heating of the recording material may also proceed by means of pixel-wise modulated ultra-sound.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light. For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of COMPARATIVE EXAMPLES 1 to 3 and INVENTION EXAMPLES 1 to 17. The percentages and ratios given in these examples are by weight unless otherwise indicated. The ingredients used in the invention and comparative examples, are:

organic silver salt:
- AgB=silver behenate;

organic reducing agent:
- R01=n-butyl 3,4-dihydroxybenzoate;
- R02=ethyl 3,4-dihydroxybenzoate;
- R03=3,4-dihydroxybenzonitrile;
- R04=3,4-dihydroxyacetophenone;
- R05=3,4-dihydroxybenzophenone;

non-stabilizing dicarboxylic acid:
- D01=adipic acid;

antifoggants:
- S01=tetrachlorophthalic acid anhydride;
- S02=benzotriazole;

toning agent:
- TA01=phthalazine phase II and phase III silver behenate-stabilizing compounds:
- P01=glutaric acid;
- P02=benzo[e][1,3]oxazine-2,4-dione;
- P03=7-(ethylcarbonato)-benzo[e][1,3]oxazine-2,4-dione;
- P04=phthalazinone;
- P05=S-LEC BL5-HPZ, a polyvinyl butyral binder from SEKISUI Chemical Co. Ltd;
- P06=BUTVAR™ B79, a polyvinyl butyral binder from SOLUTIA;

silicone oil:
- Oil=BAYSILON™ MA, a polydimethylsiloxane from BAYER;

surfactant:
- S01=MARLON™ A-396, sodium dodecyl sulfonate from HULS.

INVENTION EXAMPLES 1 AND 2 AND COMPARATIVE EXAMPLE 1

The substantially light-insensitive thermographic recording materials of INVENTION EXAMPLES 1 and 2 and COMPARATIVE EXAMPLE 1 were produced by coating a subbed 175 μm thick blue-pigmented polyethylene terephthalate support (a*=−6.86; b*=−14.46; Dvis=0.181) with a composition containing 2-butanone as solvent/dispersing medium, so as to obtain thereon, after drying, the thermosensitive elements of INVENTION EXAMPLES 1 and 2 and COMPARATIVE EXAMPLE 1 with the compositions given in Table 2:

TABLE 2

| | | Phase II and III AgB stabilizers | | | | | Reducing agent | | | | |
|---|---|---|---|---|---|---|---|---|---|---|---|
| | AgB | P01 | P02 | P03 | P05 | Oil | | | S01 | S02 | D01 |
| | [g/m²] | [g/m²] | [g/m²] | [g/m²] | [g/m²] | mg/m² | g/m² | type | g/m² | g/m² | g/m² |
| Invention Example nr. | | | | | | | | | | | |
| 1 | 3.72 | 0.289 | 0.203 | 0.105 | 14.87 | 0.033 | 0.750 | R02 | 0.117 | 0.097 | — |
| 2 | 3.72 | 0.266 | 0.203 | 0.105 | 14.87 | 0.033 | 0.750 | R02 | 0.117 | 0.097 | — |
| Comparative example nr. 1 | 4.105 | — | 0.223 | 0.115 | 12.315 | 0.036 | 0.827 | R02 | 0.130 | 0.108 | 0.293 |

The thermosensitive element was then provided with a protective layer by coating with an aqueous composition with the following composition expressed as weight percentages of ingredients present:

| | |
|---|---|
| polyvinylalcohol (Polyviol ™ WX 48/20 from Wacker Chemie): | 2.5% |
| Ultravon ™ W (dispersion agent from Ciba Geigy) converted into acid form by passing through an ion exchange column: | 0.09% |
| talc (type P3 from Nippon Talc): | 0.05% |
| colloidal silica (Levasil ™ VP AC 4055 from Bayer AG, a 15% aqueous dispersion of colloidal silica): | 1.2% |
| silica (Syloid ™ 72 from Grace): | 0.10% |
| mono[isotridecyl polyglycolether (3 EO)] phosphate (Servoxyl ™ VPDZ 3/100 from Servo Delden B.V.): | 0.09% |
| mixture of monolauryl and dilauryl phosphate (Servoxyl ™ VPAZ 100 from Servo Delden B.V.): | 0.09% |
| glycerine monotallow acid ester (Rilanit ™ GMS from Henkel AG): | 0.18% |
| tetramethylorthosilicate hydrolyzed in the presence of methanesulfonic acid: | 2.1% |

The pH of the coating composition was adjusted to a pH of 3.8 by adding 1N nitric acid. Those lubricants in these compositions which were insoluble in water, were dispersed in a ball mill with, if necessary, the aid of a dispersion agent. The compositions were coated to a wet layer thickness of 85 μm and were then dried at 40° C. for 15 minutes and hardened at 45° C. for 7 days thereby producing a protective layer.

Thermographic Printing

The printing was carried out with a DRYSTAR® 3000 printer from AGFA-GEVAERT equipped with a thin film thermal head with a resolution of 300 dpi and was operated with line times (the line time being the time needed for printing one line) of 11.8 ms and 4.5 ms respectively (corresponding to 63 mW/pixel and 96 mW/pixel respectively). During this line time the print head received constant power. The thermal head resistors were time-modulated to produce different image densities.

The substantially light-insensitive thermographic recording materials of INVENTION EXAMPLES 1 and 2 and COMPARATIVE EXAMPLE 1 were printed at line times of 11.8 ms and 4.5 ms in such a manner that a step wedge was produced with 8 density steps from 0 to 7 corresponding to equal increments of heating energy, step 0 corresponding to a heat energy ca. 25% of that of step 7 corresponded to the minimum image density, $D_{min}$, and step 7 corresponded to the maximum image density, $D_{max}$, respectively.

Evaluation of the Density Steps by X-ray Diffraction Spectroscopy

The X-ray diffraction spectra were determined in a Philips X'Pert XRD apparatus with a CuKα X-ray source for the density steps of the step wedges obtained with the substantially light-insensitive thermographic recording materials of INVENTION EXAMPLES 1 and 2 and COMPARATIVE EXAMPLE 1 at line times of 11.8 and 4.5 ms respectively.

The presence of phase I silver behenate was detected in the step wedges produced upon printing the substantially light-insensitive thermographic recording materials of INVENTION EXAMPLES 1 and 2 and COMPARATIVE EXAMPLE 1 was established by the presence of strong peaks at characteristic Bragg angle 2Θ at 4.53°, 5.96–6.05°, 7.46–7.56°, 8.90–9.12°, 10.45–10.66°, 12.02–12.12°, 13.53–13.62° and the presence of phase II and phase III silver behenate phases in prints produced with the substantially light-insensitive thermographic recording materials of INVENTION EXAMPLES 1 and 2 by the presence of strong peaks at characteristic Bragg angles 2Θ of 4.76–4.81° and 6.76–7.35°, which are the principal phase III silver behenate peaks boosted by overlap with the phase II silver behenate present in lower concentrations than the phase III silver behenate.

The concentrations of phase I silver behenate and of the combined phase II and phase III silver behenate in the density steps of the step wedges in the prints produced with the substantially light-insensitive thermographic recording materials of INVENTION EXAMPLES 1 and 2 and COMPARATIVE EXAMPLE 1 at line times of 11.8 ms and 4.5 ms were determined by adding up the peak heights of the above-mentioned peaks for the respective phases or phase combinations. Relative concentration of phase I silver behenate and of the combined phase II and phase III silver behenate with respect to the concentration of phase I silver behenate in step 0 (corresponding to $D_{min}$), arbitrarily set at 100%, are summarized in Table 3 below for line times of 11.8 ms and 4.5 ms.

However, this normalization procedure normalizes to the crystallization condition of silver behenate in step 0 applying after printing and not to the original concentration of phase I silver behenate. Exposure to ca. 25% of the heat energy for step 7 during the printing process is known to reduce the crystallinity, i.e. the quantity of phase I silver behenate, by up to a factor of two. Therefore, this procedure will underestimate the quantity of phase I silver behenate before printing by up to a factor of two. As a result the relative percentages reported are a considerable overestimate, but notwithstanding this deficiency serve to illustrate the present invention.

Only phase I silver behenate was observed in prints produced with the substantially light-insensitive thermographic recording material of COMPARATIVE EXAMPLE 1 at line times of 11.8 ms and 4.5 ms.

On the other hand, the relative percentages of phase I silver behenate phase and the combination of the phase II and phase III silver behenate for prints produced with the substantially light-insensitive thermographic recording materials of INVENTION EXAMPLES 1 and 2 clearly show that phase II and phase III silver behenate are present in the density steps produced at line times of 11.8 ms and 4.5 ms. As regards interpretation of these results, it is important to note that it is in steps 1, 2 and 3 of the step wedge (approximately corresponding to densities of 0.5, 1.0 and 1.5 respectively) that the strongest effects on image tone are observed.

TABLE 3

| | | line time = 11.8 ms | | | line time = 4.5 ms | | |
|---|---|---|---|---|---|---|---|
| Example nr | Step nr | phase I AgB phase [%] | Phase II & phase III AgB [%] | Total of AgB phases [%] | phase I AgB phase [%] | Phase II & phase III AgB [%] | Total of AgB phases [%] |
| Comparative 1 | 0 | 100 | 0.0 | 100 | 100 | 0.0 | 100 |
| | 1 | 7.6 | 0.0 | 7.6 | 24.8 | 0.0 | 24.8 |
| | 2 | 5.8 | 0.0 | 5.8 | 12.7 | 0.0 | 12.7 |
| | 3 | 3.0 | 0.0 | 3.0 | 7.5 | 0.0 | 7.5 |
| | 4 | 2.7 | 0.0 | 2.7 | 4.9 | 0.0 | 4.9 |

TABLE 3-continued

| Example nr | Step nr | line time = 11.8 ms phase I AgB phase [%] | Phase II & phase III AgB [%] | Total of AgB phases [%] | line time = 4.5 ms phase I AgB phase [%] | Phase II & phase III AgB [%] | Total of AgB phases [%] |
|---|---|---|---|---|---|---|---|
| | 5 | 2.1 | 0.0 | 2.1 | 4.6 | 0.0 | 4.6 |
| | 6 | 0.0 | 0.0 | 0.0 | 3.9 | 0.0 | 3.9 |
| | 7 | 0.0 | 0.0 | 0.0 | 0.0 | 0.0 | 0.0 |
| Invention 1 | 0 | 100 | 0.0 | 100 | 100 | 0.0 | 100 |
| | 1 | 24.9 | 19.3 | 44.2 | 37.7 | 16.1 | 53.8 |
| | 2 | 19.6 | 22.2 | 41.8 | 22.6 | 14.7 | 37.3 |
| | 3 | 12.6 | 16.8 | 29.4 | 13.0 | 12.0 | 25.0 |
| | 4 | 5.6 | 10.5 | 16.1 | 9.9 | 12.0 | 21.9 |
| | 5 | 3.8 | 7.6 | 11.4 | 6.2 | 9.2 | 15.4 |
| | 6 | 2.9 | 6.4 | 9.4 | 5.1 | 7.5 | 12.7 |
| | 7 | 1.5 | 4.4 | 5.8 | 1.7 | 6.2 | 7.9 |
| Invention 2 | 0 | 100 | 0.0 | 100 | 95.3 | 4.7 | 100 |
| | 1 | 18.6 | 14.5 | 33.1 | 36.0 | 15.8 | 51.8 |
| | 2 | 11.8 | 14.8 | 26.6 | 19.0 | 12.3 | 31.2 |
| | 3 | 5.9 | 12.7 | 18.6 | 14.6 | 18.2 | 32.8 |
| | 4 | 3.3 | 9.2 | 12.4 | 7.1 | 12.3 | 19.4 |
| | 5 | 3.0 | 5.6 | 8.6 | 3.2 | 9.5 | 12.6 |
| | 6 | 0.6 | 3.0 | 3.6 | 1.2 | 6.3 | 7.5 |
| | 7 | 0.3 | 2.4 | 2.7 | 0.0 | 4.0 | 4.0 |

Image Evaluation

The image tone of fresh prints made with the substantially light-insensitive thermographic recording materials of INVENTION EXAMPLES 1 and 2 was assessed on the basis of the L*, a* and b* CIELAB-values as described above. The a* and b* CIELAB-values 24 hours after printing of the substantially light-insensitive thermographic recording materials of INVENTION EXAMPLES 1 and 2 at an optical density, D, of 1.0, approximating to step 2, are given in Table 4 for line times of 11.8 ms and 4.5 ms.

In evaluating these image tone data, a useful reference as regards image tone is the clinically well received SCOPIX™ LT2B film with a* and b* CIELAB values at a density D=1.0 of −4.5 and −8.8 respectively. As regards clinical perception, the blue tone, as represented by the negative b* value, is more important than the a* value.

TABLE 4

| | CIELAB values for D = 1.0 (line time = 11.8 ms) | | CIELAB values for D = 1.0 (line time = 4.5 ms) | |
|---|---|---|---|---|
| | a* | b* | a* | b* |
| Invention example nr. | | | | |
| 1 | −5.12 | −7.88 | −0.15 | −12.44 |
| 2 | −3.90 | −8.05 | 2.14 | −11.00 |
| Comparative example nr. | | | | |
| 1 | −6.13 | −4.28 | −4.59 | −6.27 |

It can be seen that the CIELAB values obtained with prints produced with the substantially light-insensitive thermographic recording materials of INVENTION EXAMPLES 1 and 2, that the b* values are substantially more negative than those obtained with prints produced with the substantially light-insensitive thermographic recording materials of COMPARATIVE EXAMPLES 1. Thus, the additional presence of phase II and III silver behenate can be seen as having a tone modifying influence on the thermographic image.

INVENTION EXAMPLES 3 TO 6

The thermographic recording materials of INVENTION EXAMPLES 3 to 6 were produced by coating a subbed 175 μm thick blue-pigmented polyethylene terephthalate support (a*=−6.86; b*=−14.46; Dvis=0.181) with a composition containing 2-butanone as solvent/dispersing medium, so as to obtain thereon, after drying, the thermosensitive elements of INVENTION EXAMPLES 3 to 6 with the compositions given in Table 5:

TABLE 5

| Invention example nr. | AgB g/m² | Phase II and III AgB stabilizers P01 [g/m²] | P02 [g/m²] | P03 [g/m²] | P05 [g/m²] | Oil mg/m² | Reducing agent type | Reducing agent g/m² | S01 g/m² | S02 g/m² |
|---|---|---|---|---|---|---|---|---|---|---|
| 3 | 3.70 | 0.26 | 0.203 | 0.105 | 14.9 | 33 | R02 | 0.75 | 0.12 | 0.10 |
| 4 | 3.70 | 0.26 | 0.203 | 0.105 | 14.9 | 33 | R03 | 0.56 | 0.12 | 0.10 |
| 5 | 3.70 | 0.26 | 0.203 | 0.105 | 14.9 | 33 | R04 | 0.63 | 0.12 | 0.10 |
| 6 | 3.70 | 0.26 | 0.203 | 0.105 | 14.9 | 33 | R05 | 0.88 | 0.12 | 0.10 |

Thermographic Printing

During the thermographic printing of the substantially light-insensitive thermographic recording materials of INVENTION EXAMPLES 3 to 6, the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

Printing was carried out with a DRYSTAR® 2000 printer from AGFA-GEVAERT equipped with a thin film thermal head with a resolution of 300 dpi and line times (the line time being the time needed for printing one line) of 11.8 ms, 7.0 ms and 4.5 ms (corresponding to 90 mW/pixel, 99 mW/pixel and 108 mW/pixel respectively). During this line time the print head received constant power. The thermal head resistors were time-modulated to produce different image densities.

The substantially light-insensitive thermographic recording materials of INVENTION EXAMPLES 3 to 6 were printed at line times of 11.8 ms, 7.0 ms and 4.5 ms in such a manner that a step wedge was produced with 8 steps from 0 to 7 corresponding to equal increments of heating energy, step 0 corresponding to a heat energy ca. 25% of that of step 7 and corresponding to the minimum and maximum densities of the image, $D_{min}$ and $D_{max}$ respectively.

The densities of the images measured through a visible filter with a MACBETH™ TR924 densitometer were determined for step 7, corresponding to $D_{max}$ for prints obtained with the substantially light-insensitive thermographic recording materials of INVENTION EXAMPLES 3 to 6 at line times of 11.8 ms, 7 ms and 4.5 ms respectively and the results are given in Table 6 and 7.

Image Evaluation

Image evaluation of the substantially light-insensitive thermographic recording materials of INVENTION EXAMPLES 3 to 6 was carried out as described for the substantially light-insensitive thermographic recording materials of INVENTION EXAMPLES 1 and 2 and COMPARATIVE EXAMPLE 1 except that the a* and b* CIELAB-values of the substantially light-insensitive thermographic recording materials of INVENTION EXAMPLES 3 to 6 at an optical density, D, of 1.0 were determined 5 minutes and 24 hours after printing. The results are given in Tables 6 and 7 respectively.

TABLE 6

| Invention Example nr. | AgB g/m² | P01 g/m² | Phase II and III AgB stabilizers: P02 mol % vs AgB | P03 mol % vs AgB | P05 g/m² | $D_{max}$ (vis) | CIELAB b*-values for D = 1.0: t = 5 min | t = 24 h | Δb* |
|---|---|---|---|---|---|---|---|---|---|
| LINE TIME = 11.8 ms | | | | | | | | | |
| 3 | 3.70 | 0.26 | 14.93 | 4.99 | 14.9 | 2.84 | −13.7 | −12.8 | +0.9 |
| 4 | 3.70 | 0.26 | 14.93 | 4.99 | 14.9 | 2.25 | −8.1 | −7.2 | +0.9 |
| 5 | 3.70 | 0.26 | 14.93 | 4.99 | 14.9 | 2.93 | −12.7 | −12.1 | +0.6 |
| 6 | 3.70 | 0.26 | 14.93 | 4.99 | 14.9 | 2.97 | −12.2 | −11.7 | +0.5 |
| LINE TIME = 7.0 ms | | | | | | | | | |
| 3 | 3.70 | 0.26 | 14.93 | 4.99 | 14.9 | 2.71 | −13.7 | −13.9 | −0.2 |
| 4 | 3.70 | 0.26 | 14.93 | 4.99 | 14.9 | 2.12 | −9.3 | −8.6 | +0.7 |
| 5 | 3.70 | 0.26 | 14.93 | 4.99 | 14.9 | 2.89 | −14.1 | −13.6 | +0.5 |
| 6 | 3.70 | 0.26 | 14.93 | 4.99 | 14.9 | 2.83 | −13.2 | −13.0 | +0.2 |
| LINE TIME = 4.5 ms | | | | | | | | | |
| 3 | 3.70 | 0.26 | 14.93 | 4.99 | 14.9 | 1.82 | −15.8 | −12.7 | +3.1 |
| 4 | 3.70 | 0.26 | 14.93 | 4.99 | 14.9 | 1.48 | −10.2 | −9.2 | +1.0 |
| 5 | 3.70 | 0.26 | 14.93 | 4.99 | 14.9 | 2.03 | −15.8 | −14.1 | +1.7 |
| 6 | 3.70 | 0.26 | 14.93 | 4.99 | 14.9 | 1.95 | −14.4 | −12.6 | +1.8 |

Table 6 shows that a shift in b* for D=1.0 takes place between 5 minutes and 24 hours after printing. This shift is between +0.5 and +0.9 for a line time of 11.8 ms; −0.2 and +0.7 for a line time of 7.0 ms; and +1.0 to +3.1 for a line time of 4.5 ms. The shifts of the thermographic recording materials of INVENTION EXAMPLES 3, 4, 5 and 6 are acceptable for line times of 11.8 and 7.0 ms, but it is desirable to reduce the line time to 4.5 ms so that the throughput can be optimized. However, in the case of a 4.5 ms line time the shift in b* is only acceptable in the case of the thermographic recording material of INVENTION EXAMPLE 4 containing the AgB phase II and phase III stabilizer compounds P01, P02 and P03 together with the reducing agent R03 (3,4-dihydroxybenzonitrile).

Table 7 shows that a shift in a* for D=1.0 takes place between 5 minutes and 24 hours after printing. This shift is between 0.0 and +0.4 for a line time of 11.8 ms; −0.7 and +0.5 for a line time of 7.0 ms; and +0.7 to +2.4 for a line time of 4.5 ms. The shifts of the thermographic recording materials of INVENTION EXAMPLES 3, 4, 5 and 6 are acceptable for line times of 11.8 and 7.0 ms, but it is desirable to reduce the line time to 4.5 ms so that the throughput can be optimized. However, in the case of a 4.5 ms line time the shift in a* is only acceptable in the case of the thermographic recording material of INVENTION EXAMPLE 4 containing P01, P02 and P03 as the AgB phase II and phase III stabilizer compounds in combination with the reducing agent R03 (3,4-dihydroxybenzonitrile.

TABLE 7

| Invention Example Nr. | AgB g/m² | P01 g/m² | Phase II and III AgB stabilizers: P02 mol % vs AgB | P03 mol % vs AgB | $D_{max}$ (vis) | CIELAB a*-values for D = 1.0: t = 5 min | t = 24 h | Δa* |
|---|---|---|---|---|---|---|---|---|
| LINE TIME = 11.8 ms | | | | | | | | |
| 3 | 3.70 | 0.26 | 14.93 | 4.99 | 2.84 | −2.4 | −2.0 | +0.4 |
| 4 | 3.70 | 0.26 | 14.93 | 4.99 | 2.25 | −4.8 | −4.8 | 0.0 |
| 5 | 3.70 | 0.26 | 14.93 | 4.99 | 2.93 | −3.3 | −3.2 | +0.1 |
| 6 | 3.70 | 0.26 | 14.93 | 4.99 | 2.97 | −2.7 | −2.4 | +0.3 |
| LINE TIME = 7.0 ms | | | | | | | | |
| 3 | 3.70 | 0.26 | 14.93 | 4.99 | 2.71 | 0.6 | 1.1 | +0.5 |
| 4 | 3.70 | 0.26 | 14.93 | 4.99 | 2.12 | −3.9 | −4.2 | −0.3 |
| 5 | 3.70 | 0.26 | 14.93 | 4.99 | 2.89 | −1.0 | −0.9 | +0.1 |
| 6 | 3.70 | 0.26 | 14.93 | 4.99 | 2.83 | 0.6 | −0.1 | −0.7 |
| LINE TIME = 4.5 ms | | | | | | | | |
| 3 | 3.70 | 0.26 | 14.93 | 4.99 | 1.82 | 5.2 | 7.6 | +2.4 |
| 4 | 3.70 | 0.26 | 14.93 | 4.99 | 1.48 | −1.6 | −0.9 | +0.7 |
| 5 | 3.70 | 0.26 | 14.93 | 4.99 | 2.03 | 3.3 | 5.0 | +1.7 |
| 6 | 3.70 | 0.26 | 14.93 | 4.99 | 1.95 | 5.3 | 6.8 | +1.5 |

In conclusion the thermographic recording materials of INVENTION EXAMPLES 3, 4, 5 and 6 are all suitable for use with printers with line times of 11.8 and 7.0 ms, but only the thermographic recording material of INVENTION EXAMPLE 4 is suitable for use with a printer with a line time of 4.5 ms.

This shows that the tone modifying properties of phase II silver behenate and phase III silver behenate, when used in combination with 3,4-dihydroxybenzonitrile as reducing agent, produce particularly favourable image tones at printer line times of 4.5 ms.

X-ray Diffraction Evaluation

X-ray diffraction measurements were carried out as described for INVENTION EXAMPLES 1 and 2 and COMPARATIVE EXAMPLE 1 in real time on the thermographic recording materials of INVENTION EXAMPLES 3 to 6 after they emerged from the DRYSTAR® 2000 printer. The amount of noise due to the rapid XRD-scans meant that only qualitative information could be obtained from these measurements. This information is summarized in Table 8.

TABLE 8

| Invention example nr. | Reducing agent | Printer line time 11.8 ms | 4.5 ms |
|---|---|---|---|
| 3 | R02 | conc. phase I << conc. phases II & III | conc. phase I = conc. phases II & III |
| | | more crystallization for 11.8 ms line time versus 4.5 ms | |
| | | more crystallization versus R03, R04 & R04 for 11.8 ms | |
| 4 | R03 | only phases II & III present | only phases II & III present |
| | | less crystallization than with R02, R04 and R05 | |
| 5 | R04 | | conc. phase I < conc. phases II & III |
| 6 | R05 | | conc. phase I < conc. phases II & III |

The change in image tone subsequent to thermal development is accompanied by changes in the phase structure of the silver behenate. In the case of the thermographic recording materials of INVENTION EXAMPLES 3, 5 and 6 the concentrations of phase I, phase II and phase III silver behenate increased in the first 15 minutes after thermal development. However, in the case of the thermographic recording material of INVENTION EXAMPLE 4 in which glutaric acid is present together with R03 as the reducing agent (3,4-dihydroxybenzonitrile) this effect was considerably reduced and phase II and phase III silver behenate was principally observed with no detectable phase I silver behenate.

INVENTION EXAMPLE 7 AND COMPARATIVE EXAMPLE 2

The thermographic recording materials of INVENTION EXAMPLE 7 AND COMPARATIVE EXAMPLE 2 were produced by coating a subbed 175 μm thick blue-pigmented polyethylene terephthalate support (a*=6.86; b*=−14.46; Dvis=0.181) with a composition containing 2-butanone as solvent/dispersing medium, so as to obtain thereon, after drying, the thermosensitive elements of INVENTION EXAMPLE 7 AND COMPARATIVE EXAMPLE 2 with the compositions given in Table 9:

TABLE 9

| Example Nr. | | Comparative 2 | Invention 7 |
|---|---|---|---|
| AgB [g/m²] | | 4.11 | 3.71 |
| P01* [g/m²] | | — | 0.266 |
| P02* [g/m²] | | 0.223 | 0.203 |
| P03* [g/m²] | | 0.115 | 0.105 |
| P06* [g/m²] | | 12.315 | 14.87 |
| Oil [mg/m²] | | 0.036 | 0.033 |
| Reducing agent | type | R02 | R02 |
| | [g/m²] | 0.827 | 0.750 |
| S01 [g/m²] | | 0.13 | 0.117 |
| S02 [g/m²] | | 0.108 | 0.097 |
| D01 [g/m²] | | 0.293 | — |

*Phase II and III AgB stabilizer

The thermosensitive element was then provided with a protective layer by coating with an aqueous composition with the following composition expressed as weight percentages of ingredients present:

| | |
|---|---|
| polyvinylalcohol (Polyviol ™ WX 48/20 from Wacker Chemie): | 2.5% |
| Ultravon ™ W (dispersion agent from Ciba Geigy) converted into acid form by passing through an ion exchange column: | 0.09% |
| talc (type P3 from Nippon Talc): | 0.05% |
| colloidal silica (Levasil ™ VP AC 4055 from Bayer AG, a 15% aqueous dispersion of colloidal silica): | 1.2% |
| silica (Syloid ™ 72 from Grace): | 0.10% |
| mono[isotridecyl polyglycolether (3 EO)] phosphate (Servoxyl ™ VPDZ 3/100 from Servo Delden B.V.): | 0.09% |
| mixture of monolauryl and dilauryl phosphate (Servoxyl ™ VPAZ 100 from Servo Delden B.V.): | 0.09% |
| glycerine monotallow acid ester (Rilanit ™ GMS from Henkel AG): | 0.18% |
| tetramethylorthosilicate hydrolyzed in the presence of methanesulfonic acid: | 2.1% |

The pH of the coating composition was adjusted to a pH of 3.8 by adding 1N nitric acid. Those lubricants in these compositions which were insoluble in water, were dispersed in a ball mill with, if necessary, the aid of a dispersion agent. The compositions were coated to a wet layer thickness of 85 μm and were then dried at 40° C. for 15 minutes and hardened at 45° C. for 7 days thereby producing a protective layer.

Thermographic Printing

Printing was carried out with a DRYSTAR® 4500 printer from AGFA-GEVAERT equipped with a thin film thermal head with a resolution of 508 dpi adapted to print at a line time (the line time being the time needed for printing one line) of 12 ms (corresponding to 35 mW/pixel). During this line time the print head received constant power. The thermal head resistors were time-modulated to produce different image densities.

The substantially light-insensitive thermographic recording materials of COMPARATIVE EXAMPLE 2 and INVENTION EXAMPLE 7 were printed in such a manner that a step wedge was produced with 8 steps from 0 to 7 corresponding to equal increments of heating energy, step 0 corresponding to a heat energy ca. 25% of that of step 7 and corresponding to the minimum and maximum densities of the image, $D_{min}$ and $D_{max}$ respectively.

The densities of the images measured through a visible filter with a MACBETH™ TR924 densitometer were determined for all eight steps for prints obtained with the substantially light-insensitive thermographic recording materials of COMPARATIVE EXAMPLE 2 and INVENTION EXAMPLE 7 and the values are summarized in Table 10.

Evaluation of the Density Steps by X-ray Diffraction Spectroscopy

The X-ray diffraction spectra were determined in a Philips X'Pert XRD apparatus with a CuKα X-ray source for the density steps of the step wedges obtained with the substantially light-insensitive thermographic recording materials of COMPARATIVE EXAMPLE 2 and INVENTION EXAMPLE 7.

The presence of phase I silver behenate was detected in the step wedges produced upon printing the substantially light-insensitive thermographic recording materials of COMPARATIVE EXAMPLE 2 and INVENTION EXAMPLE 7 was established by the presence of strong peaks at characteristic Bragg angle 2Θ at 4.53°, 5.96–6.05°, 7.46–7.56°, 8.90–9.12°, 10.45–10.66°, 12.02–12.12°, 13.53–13.62° and the presence of phase II and phase III silver behenate phases in prints produced with the substantially light-insensitive thermographic recording material of INVENTION EXAMPLE 7 by the presence of strong peaks at characteristic Bragg angles 2Θ of 4.76–4.81° and 6.76–7.35°, which are the principal phase III silver behenate peaks boosted by overlap with the phase II silver behenate present in lower concentrations than the phase III silver behenate.

The results obtained expressed as percentages with respect to the quantity of phase I silver behenate present in the thermographic recording materials before thermal development are summarized in Table 10 below.

TABLE 10

| Example nr | Step nr | Density (vis filter) | phase I AgB phase [%] | phase II & phase III AgB [%] | total of AgB phases [%] |
|---|---|---|---|---|---|
| Comparative 2 | 0 | 0.23 | 80.2 | 0.0 | 80.2 |
| | 1 | 0.23 | 88.8 | 0.0 | 88.8 |
| | 2 | 0.23 | 85.5 | 0.0 | 85.5 |
| | 3 | 0.26 | 27.3 | 0.0 | 27.3 |
| | 4 | 0.65 | 8.6 | 0.0 | 8.6 |
| | 5 | 1.70 | 2.2 | 0.0 | 2.2 |
| | 6 | 2.95 | 2.0 | 0.0 | 2.0 |
| | 7 | 3.97 | 2.0 | 0.0 | 2.0 |
| Invention 7 | 0 | 0.22 | 81.9 | 0.0 | 81.9 |
| | 1 | 0.22 | 83.8 | 0.0 | 83.8 |
| | 2 | 0.22 | 87.1 | 0.0 | 87.1 |
| | 3 | 0.23 | 27.7 | 5.0 | 32.7 |
| | 4 | 0.68 | 9.1 | 13.8 | 22.9 |
| | 5 | 1.94 | 1.9 | 6.2 | 8.1 |
| | 6 | 2.86 | 1.9 | 2.1 | 4.0 |
| | 7 | 3.14 | 0.2 | 0.5 | 0.7 |

It can be seen that exposure to ca. 25% of the heat energy for step 7 during the printing process reduced the crystallinity, i.e. the quantity of phase I silver behenate observed, by between 5 and 20 mol %.

In the case of the substantially light-insensitive thermographic recording materials of COMPARATIVE EXAMPLE 2 and INVENTION EXAMPLE 7, the amount of phase I silver behenate decreased with increasing heating energy and increasing optical density.

No phase II and III silver behenate was observed with the substantially light-insensitive thermographic recording material of COMPARATIVE EXAMPLE 2.

With the substantially light-insensitive thermographic recording material of INVENTION EXAMPLE 7, phase II and phase III silver behenate was observed from step 3 with the maximum quantity observed in step 4.

As regards interpretation of these results, it is important to note that it is in steps 3, 4 and 5 of the step wedge (corresponding approximately to densities of 0.25, 0.65 and 1.8 respectively) that the strongest effects on image tone are observed.

Image Evaluation

The image tone of fresh prints made with the substantially light-insensitive thermographic recording materials of COMPARATIVE EXAMPLE 1 and INVENTION EXAMPLE 7 was assessed on the basis of the L*, a* and b* CIELAB-values as described above. The a* and b* CIELAB-values 24 hours after printing are given below in Table 11 for the substantially light-insensitive thermographic recording materials of COMPARATIVE EXAMPLE 1 and INVENTION EXAMPLE 7 at optical densities, D, of 1.0 and 2.0.

TABLE 11

| | Dmax | Dmin | CIELAB results: D = 1.0 | | CIELAB results: D = 2.0 | |
|---|---|---|---|---|---|---|
| | (vis) | (vis) | a* | b* | a* | b* |
| Comparative Example nr 2 | 3.97 | 0.23 | −6.36 | −3.71 | −2.63 | −2.73 |
| Invention Example nr 7 | 3.14 | 0.22 | −4.29 | −8.48 | −0.52 | −5.22 |

The much higher CIELAB b*-values observed with the substantially light-insensitive thermographic recording material of INVENTION EXAMPLE 7 compared with the substantially light-insensitive thermographic recording material of COMPARATIVE EXAMPLE 2, demonstrate the favourable impact of the presence of phase II and phase III silver behenate on the image tone of substantially light-insensitive thermographic recording materials.

INVENTION EXAMPLES 8 TO 19 AND COMPARATIVE EXAMPLES 3 AND 4

X-ray Diffraction Experiments with Mixtures of Silver Behenate with Different Phase II and Phase III Silver Behenate-stabilizing Compounds The materials of INVENTION EXAMPLES 8 to 19 and COMPARATIVE EXAMPLES 3 and 4 consisted of mixtures of silver behenate with different phase II and III silver behenate-stabilizing compounds with the compositions given in Table 12.

The silver behenate for INVENTION EXAMPLES 8 to 13 and COMPARATIVE EXAMPLES 3 and 4 was used as a 24% by weight solids aqueous dispersion containing silver behenate particles stabilized with 6.3% by weight of surfactant S01 and this was mixed with the required molar ratio of phase II and phase III silver behenate-stabilizing compound and then dried before heating the resulting mixture in the sample holder of a Philips X'Pert XRD (X-ray diffraction) apparatus.

The silver behenate for INVENTION EXAMPLES 14 to 19 was used as a methylethylketone dispersion with 20.25% by weight of solids and containing silver behenate particles stabilized with P05 in a weight ratio of 0.8:1. This was mixed with the required molar ratio of phase II and phase III silver behenate-stabilizing compound and then dried before heating the resulting mixture in the sample holder of a Philips X'Pert XRD (X-ray diffraction) apparatus.

X-ray Diffraction Evaluation

The materials of INVENTION EXAMPLES 8 to 19 and COMPARATIVE EXAMPLES 3 and 4 were heated up in the Philips X'Pert XRD apparatus with a CuKα X-ray source from 25° C. to 100° C. and then from 100° C. to 200° C. in 10° C. intervals with an XRD-spectrum being taken in the 2θ-range: 5–50° in a continuous scan and finally from 200 to 25° C. The evolution of the XRD-spectrum of silver behenate with increasing temperature was similar, with phase changes being observed at 120° C. (part of AgB becoming amorphous), at 138° C. (additional XRD-peaks, new structure=second phase transition), at 156° C. (additional XRD-peaks, new structure=third phase transition). This new structure was observed 10° C. lower in the case of P03 than with the other phase II and III silver behenate-stabilizing compounds. From 170° C. silver metal formation was observed, which was more pronounced in the presence of the phase II and phase III silver behenate-stabilizing compounds (INVENTION EXAMPLES 8 to 19) than in their absence (COMPARATIVE EXAMPLES 3 and 4). The materials were then cooled to 25° C. and a further XRD-spectrum taken. The quantity of silver behenate which crystallized upon cooling to 25° C. with respect to the quantity of phase I silver behenate before heating was determined as described for INVENTION EXAMPLES 1 and 2 and COMPARATIVE EXAMPLE 1. The results are summarized in Table 12.

TABLE 12

| | phase II and III AgB-stabilizing compound | | Percentage crystallization upon cooling to 25° C. with respect to initial phase I AgB | | |
|---|---|---|---|---|---|
| | type | mol/mol. AgB | total | as phase I AgB | as phase II & III AgB |
| Invention example nr | | | | | |
| 8 | P01 | 0.26 | 49.7 | 3.8 | 45.9 |
| 9 | P02 | 0.075 | 6.5 | 5.5 | 1.0 |
| 10 | P03 | 0.26 | 2.98 | 2.63 | 0.35 |
| 11 | P03 | 0.321 | 5.2 | 1.7 | 3.5 |
| 12 | P04 | 0.225 | 3.3 | 2.4 | 0.9 |
| 13 | P04 | 0.26 | 3.3 | 2.4 | 0.9 |
| 14 | P05 | 2.52* | 6.4 | 4.6 | 1.8 |
| 15 | P05/P01 | 2.52*/0.26 | 26.8 | 0.4 | 26.4 |
| 16 | P05/P02 | 2.52*/0.26 | 3.5 | 3.0 | 0.5 |
| 17 | P05/P03 | 2.52*/0.26 | 2.2 | 0.5 | 1.7 |
| 18 | P05/P04 | 2.52*/0.26 | 10.0 | 7.3 | 2.7 |
| 19 | P05/TA01 | 2.52*/0.26 | 20.6 | 16.3 | 4.3 |
| Comparative example nr. | | | | | |
| 3 | — | — | 14.2 | 14.2 | 0 |
| 4 | TA01 | 0.26 | 24.1 | 24.1 | 0 |

*on the basis of the 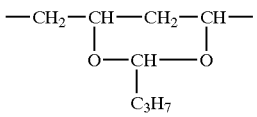 monomer group

The results of Table 12 show that compounds P01 to P05 stabilize phases II and III silver behenate at 25° C. and that the highest degree of stabilization was observed with compound P01, glutaric acid. It should be noted that P01 and TA1 promoted the formation of significantly more crystalline phase I silver behenate upon cooling the melt to 25° C., than the other compounds investigated.

Having described in detail preferred embodiments of the current invention, it will now be apparent to those skilled in the art that numerous modifications can be made therein without departing from the scope of the invention as defined in the following claims.

What is claimed is:

1. A substantially light-insensitive thermographic recording material comprising a support and a thermosensitive element, said thermosensitive element containing silver behenate including phase I silver behenate having an X-ray diffraction spectrum upon irradiation with a copper $K\alpha_1$ X-ray source with Bragg angles 2Θ of 4.53%, 5.96–6.05°, 7.46–7.56°, 8.90–9.12°, 10.45–10.66°, 12.02–12.12°, 13.53–13.62°, a reducing agent therefor in thermal working relationship therewith and a binder, wherein said thermographic recording material is capable upon thermal development of containing 1% of phase II silver behenate, having an X-ray diffraction spectrum upon irradiation with a copper $K\alpha_1$ X-ray source with Bragg angles 2Θ of 5.34–5.78°, 6.12–6.41°, 7.68–7.79°, 830–8.59°, 9.36–9.84°, 10.6–10.96°, which is stable at 25° C., with respect to said phase I silver behenate present in said thermographic recording material before said thermal development.

2. Thermographic recording material according to claim 1, wherein upon thermal development said thermographic recording material contains at least 2% of said phase II silver behenate, which is stable at 25° C., with respect to said phase I silver behenate present in said thermographic recording material before said thermal development.

3. Thermographic recording material according to claim 1, wherein upon thermal development said thermographic recording material contains at least 5% of said phase II silver, which is stable at 25° C., with respect to said phase I silver behenate present in said thermographic recording material before said thermal development.

4. Thermographic record material according to claim 1, wherein said reducing agent is 3,4-dihydroxybenzonitrile.

5. Thermographic recording material according to claim 4, wherein the concentration of said 3,4-dihydroxybenzonitrile is at least 30 mol % with respect to said silver behenate.

6. Thermographic recording material according to claim 4, wherein ethyl 3,4-dihydroxybenzoate is present as a further reducing agent.

7. Thermographic recording material according to claim 1, wherein said phase II silver behenate is stabilized by the presence of a compound selected from the group consisting of glutaric acid, benzo[e][1,3]oxazine-2,4-dione, substituted benzo[e][1,3]oxazine-2,4-dione compounds, phthalazinone and polyvinyl butyral.

8. Thermographic recording material according to claim 7, wherein said a substituted benzo[e][1,3oxazine-2,4-dione compound is selected from the group consisting of 7-(ethylcarbonato)-benzo[e][1,3]-oxazine-2,4-dione, 7-methyl-benzo[e][1,3]-oxazine-2,4-dione and 7-methoxy-benzo[e][1,3]-oxazine-2,4-dione.

9. Thermographic recording material according to claim 7, wherein said a substituted benzo[e][1,3]oxazine-2,4-dione compound is selected from the group consisting of 7-(ethylcarbonato)-benzo[e][1,3]-oxazine-2,4-dione, 7-methyl-benzo[e][1,3]-oxazine-2,4-dione and 7-methoxy-benzo[e][1,3]-oxazine-2,4-dione.

10. Thermographic recording material according to claim 1, wherein said thermographic recording material is a black and white thermographic recording material.

11. Thermographic recording material according to claim 1, wherein said thermosensitive element is provided with a protective layer.

12. A recording process for a thermographic recording material, said thermographic recording material comprising a thermosensitive element, said thermosensitive element comprising silver behenate including the phase I silver behenate defined in claim 1, an organic reducing agent therefor in thermal working relationship therewith and a binder, comprising: (i) converting said silver behenate into the phase II silver behenate defined in claim 1; and (ii) cooling said thermographic recording material to 25° C., wherein at least 1% with respect to said phase I silver behenate of said phase II silver behenate, with respect to the quantity of said phase I silver behenate in said thermographic recording material before said recording process, is present in said cooled thermally developed thermographic recording material at 25° C. as stable phases.

13. Recording process according to claim 12, wherein said recording process further comprises thermal development at a line time of less than 20 ms with an image resolution of at least 118 dots per cm.

14. Recording process according to claim 12, wherein said recording process further comprises thermal development at a time of less than 20 ms with an image resolution of at least 118 dots per cm.

15. A process for using the phase II silver behenate defined in claim 1 stabilized at 25° C. as a tone modifier in thermographic recording materials comprising the steps of: producing a coating dispersion containing silver behenate as defined in claim 1, a reducing agent therefor, a binder and an substance which stabilizes said phase II silver behenate at 25° C.; and coating said coating dispersion onto a support.

16. A substantially light-insensitive thermographic recording material comprising a support and a thermosensitive element, said thermosensitive element containing silver behenate including phase I silver behenate having an X-ray diffraction spectrum upon irradiation with a copper $K\alpha_1$ X-ray source with Bragg angles 2Θ of 4.53°, 5.96–6.05°, 7.46–7.56°, 8.90–9.12°, 10.45–10.66°, 12.02–12.12°, 13.53–13.62°, a reducing agent therefor in thermal working relationship therewith and a binder, wherein said thermographic recording material is capable upon thermal development of containing 1% with respect to said phase I silver behenate of phase III silver behenate phase, having an X-ray diffraction spectrum upon irradiation with a copper $K\alpha_1$ X-ray source with Bragg angles 2Θ of 4.76–4.81°, 5.9–6.3°, 6.76–7.35°, 8.27–8.44° and 9.06–9.43% which is stable at 25° C., with respect to the quantity of said phase I silver behenate in said thermographic recording material before said thermal development.

17. Thermographic recording material according to claim 16, wherein upon thermal development said thermographic recording material contains at least 2% of said phase III silver behenate, which is stable at 25° C., with respect to said phase I silver behenate present in said thermographic recording material before said thermal development.

18. Thermographic recording material according to claim 16, wherein upon thermal development said thermographic recording material contains at least 5% of said phase III silver behenate, which is stable at 25° C., with respect to said phase I silver behenate present in said thermographic recording material before said thermal development.

19. Thermographic recording material according to claim 16, wherein said phase III silver behenate is stabilized by the presence of a compound selected from the group consisting of: glutaric acid, benzo[e][1,3]oxazine-2,4-dione substituted benzo[e][1,3]oxazine-2,4-dione compounds, phthalazinone and polyvinyl butyral.

20. Thermographic recording material according to claim 19, wherein said a substituted benzo[e][1,3]oxazine-2,4-dione compound is selected from the group consisting of 7-(ethylcarbonato)-benzo[e][1,3]-oxazine-2,4-dione, 7-methyl-benzo[e][1,3]-oxazine-2,4-dione and 7-methoxy-benzo[e][1,3]-oxazine-2,4-dione.

21. A recording process for a thermographic recording material, said thermographic recording material comprising a thermosensitive element, said thermosensitive element comprising silver behenate including the phase I silver behenate defined in claim 16, organic reducing agent therefor in thermal working relationship therewith and a binder, comprising: (i) converting said silver behenate into the phase III silver behenate defined in claim 16; (ii) cooling said thermographic recording material to 25° C., wherein at least 1% of said phase Ill silver behenate, with respect to the quantity of said phase I silver behenate in said thermographic recording material before said recording process, is present in said cooled thermally developed thermographic recording material at 25° C. as stable phases.

22. Recording process according to claim 21, wherein said recording process further comprises thermal development at a line time of less than 20 ms with an image resolution of at least 118 dots per cm.

23. A process for using the phase III silver behenate defined in claim 16, stabilized at 25° C. as a tone modifier in thermographic recording materials comprising the steps of: producing a coating dispersion containing silver behenate as defined in claim 1, a reducing agent therefor, a binder and art substance which stabilizes said phase III silver behenate at 25° C.; and coating said coating dispersion onto a support.

24. Thermographic recording material according to claim 16, wherein said reducing agent is 3,4-dihydroxybenzonitrile.

25. Thermographic recording material according to claim 16, wherein said thermographic recording material is a black and white thermographic recording material.

26. Thermographic recording material according to claim 16, wherein said thermosensitive element is provided with a protective layer.

27. A substantially light-insensitive thermographic recording material comprising a support and a thermosensitive element, said thermosensitive element containing silver behenate including phase I silver behenate having an X-ray diffraction spectrum upon irradiation with a copper $K\alpha_1$ X-ray source with Bragg angles 2Θ of 4.53°, 5.96–6.05°, 7.46–7.56°, 8.90–9.12°, 10.45–10.66°, 12.02–12.12°, 13.53–13.62°, a reducing agent therefor in thermal working relationship therewith and a binder, wherein said thermographic recording material is capable upon thermal development of containing 1% of phase II silver behenate, having an X-ray diffraction spectrum upon irradiation with a copper $K\alpha_1$ X-ray source wit Bragg angles 2Θ of 5.34–5.78°, 6.12–6.41°, 7.68–7.79, 8.30–8.59°, 9.36–9.40°, 10.6–10.96°, which is stable at 25° C. and phase III silver behenate phase, having an X-ray diffraction spectrum upon irradiation with a copper $K\alpha_1$ X-ray source with Bragg angles 2Θ of 4.76–4.81°, 5.9–6.3°, 6.76–7.35°, 8.27–8.44° and 9.06–9.43°, which is stable at 25° C., with respect to the quantity of said phase I silver behenate in said thermographic recording material before said thermal development.

28. Thermographic recording material according to claim 27, wherein upon thermal development said thermographic recording material contains at least 2% of said phase II silver behenate which is stable at 25° C. and said phase III silver behenate which is stable at 25° C., taken together with respect to said phase I silver behenate present in said thermographic recording material before said thermal development.

29. Thermographic recording material according to claim 27, wherein upon thermal development said thermographic recording material contains at least 5% with respect to said phase I silver behenate of said phase II silver behenate which is stable at 25° C. and said phase II silver behenate, which is stable at 25° C., taken together with respect to said phase I silver behenate present in said thermographic recording material before said thermal development.

30. A recording process for a thermographic recording material, said thermographic recording material comprising a thermosensitive element, said thermosensitive element comprising silver behenate including the phase I silver behenate defined in claim 27, organic reducing agent therefor in thermal working relationship therewith and a binder, comprising: (i) converting said silver behenate into the phase II silver behenate defined in claim 27 the phase III silver behenate defined in claim 27; and (ii) cooling said thermographic recording material to 25° C., wherein at least 1% of said phase II silver behenate and said phase III silver behenate, with respect to the quantity of said phase I silver behenate in said thermographic recording material before said recording process, is present in said cooled thermally developed thermographic recording material at 25° C. as stable phases.

31. Recording process according to claim 30, wherein said recording process further comprises thermal development at a line time of less than 20 ms with an image resolution of at least 118 dots per cm.

32. Thermographic recording material according to claim 27, wherein said reducing agent is 3,4-dihydroxybenzonitrile.

33. Thermographic recording material according to claim 27, wherein said phase II silver behenate is stabilized by the presence of a compound selected from the group consisting of: glutaric acid, benzo[e][1,3]oxazine-2,4-dione, substituted benzo[e][1,3]oxazine-2,4-dione compounds, phthalazinone and polyvinyl butyral.

34. Thermographic recording material according to claim 27, wherein said phase III silver behenate is stabilized by the presence of a compound selected from the group consisting of: glutaric acid, benzo[e][1,3]oxazine-2,4-dione, substituted benzo[e][1,3]oxazine-2,4-dione compounds, phthalazinone and polyvinyl butyral.

35. Thermographic recording material according to claim 34, wherein said a substituted benzo[e][1,3]oxazine-2,4-dione compound is selected from the group consisting of 7-(ethylcarbonato)-benzo[e][1,3]-oxazine-2,4-dione, 7-methyl-benzo[e][1,3]-oxazine-2,4-dione and 7-methoxy-benzo[e][1,3]-oxazine-2,4-dione.

36. Thermographic recording material according to claim 27, wherein said thermographic recording material is a black and white thermographic recording material.

37. Thermographic recording material according to claim 27, wherein said thermosensitive element is provided with a protective layer.

* * * * *